US008708837B2

(12) United States Patent
Roach et al.

(10) Patent No.: US 8,708,837 B2
(45) **Date of Patent: *Apr. 29, 2014**

(54) GOLF CLUB HEAD WITH FACE INSERT

(71) Applicant: Cobra Golf Incorporated, Carlsbad, CA (US)

(72) Inventors: Ryan L. Roach, Carlsbad, CA (US); Joshua G. Breier, Vista, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/915,208

(22) Filed: Jun. 11, 2013

(65) Prior Publication Data

US 2013/0274030 A1 Oct. 17, 2013

Related U.S. Application Data

(63) Continuation of application No. 13/524,743, filed on Jun. 15, 2012, now Pat. No. 8,485,918, which is a continuation of application No. 12/760,953, filed on Apr. 15, 2010, now Pat. No. 8,210,965.

(51) Int. Cl.
*A63B 53/04* (2006.01)

(52) U.S. Cl.
USPC ..... 473/329; 473/332; 473/342; 473/350

(58) Field of Classification Search
USPC ..... 473/324–350, 287–292
See application file for complete search history.

(56) References Cited

U.S. PATENT DOCUMENTS

| | | | | |
|---|---|---|---|---|
| 3,970,236 | A | 7/1976 | Rogers | |
| 4,252,262 | A | 2/1981 | Igarashi | |
| 4,398,965 | A * | 8/1983 | Campau | 148/522 |
| 5,106,094 | A | 4/1992 | Desbiolles et al. | |
| 5,261,664 | A | 11/1993 | Anderson | |
| 5,362,055 | A | 11/1994 | Rennie | |
| 5,398,929 | A | 3/1995 | Kitaichi | |
| 5,405,137 | A | 4/1995 | Vincent et al. | |
| 5,417,419 | A | 5/1995 | Anderson et al. | |
| 5,431,396 | A | 7/1995 | Shieh | |
| 5,536,006 | A | 7/1996 | Shieh | |
| 5,807,189 | A | 9/1998 | Martin et al. | |
| 6,117,023 | A | 9/2000 | Onuki et al. | |
| 6,364,789 | B1 | 4/2002 | Kosmatka | |

(Continued)

OTHER PUBLICATIONS

USPTO Non-final Office Action mailed on Jun. 27, 2011 in U.S. Appl. No. 12/760,953 (12 pages).

(Continued)

*Primary Examiner* — Sebastiano Passaniti
(74) *Attorney, Agent, or Firm* — Mark S. Leonardo; Brown Rudnick LLP

(57) ABSTRACT

A golf club head with a face insert that is only partially connected to the body of the golf club head is disclosed herein. More specifically, the present invention discloses a golf club head with a face insert wherein the face insert is only connected to the body of the golf club head at specific engagement portions around the perimeter of the face insert while keeping the remainder of the perimeter unengaged. The golf club head disclosed in accordance with the present invention will allow for removal of excessive weight traditionally needed to connect the face insert to the body of the golf club head, therefore improving the performance of the golf club head.

12 Claims, 18 Drawing Sheets

(56) References Cited

U.S. PATENT DOCUMENTS

| | | | | |
|---|---|---|---|---|
| 6,638,182 | B2 | 10/2003 | Kosmatka | |
| 6,669,577 | B1 | 12/2003 | Hocknell et al. | |
| 6,672,975 | B1 * | 1/2004 | Galloway | 473/342 |
| 6,743,117 | B2 | 6/2004 | Gilbert | |
| 6,777,640 | B2 | 8/2004 | Takeda | |
| 6,780,124 | B2 | 8/2004 | Lu | |
| 6,860,823 | B2 | 3/2005 | Lee | |
| 6,863,625 | B2 | 3/2005 | Reyes et al. | |
| 7,025,693 | B2 | 4/2006 | Sugimoto | |
| 7,121,958 | B2 | 10/2006 | Cheng et al. | |
| 7,144,331 | B2 | 12/2006 | Poynor | |
| 7,160,204 | B2 | 1/2007 | Huang | |
| 7,258,628 | B2 | 8/2007 | Huang et al. | |
| 7,479,070 | B2 | 1/2009 | Hirano | |
| 7,490,070 | B2 | 2/2009 | Brickell | |
| 7,559,853 | B2 | 7/2009 | Hirano | |
| 7,604,550 | B1 | 10/2009 | Currie | |
| 7,686,706 | B2 | 3/2010 | Matsunaga et al. | |
| 7,798,916 | B2 | 9/2010 | Matsunaga et al. | |
| 8,210,965 | B2 * | 7/2012 | Roach et al. | 473/329 |
| 8,485,918 | B2 * | 7/2013 | Roach et al. | 473/329 |
| 2003/0054901 | A1 * | 3/2003 | Sun | 473/342 |
| 2008/0004131 | A1 | 1/2008 | Lin et al. | |
| 2009/0118037 | A1 | 5/2009 | Roach et al. | |
| 2010/0261546 | A1 * | 10/2010 | Nicodem | 473/340 |
| 2011/0086722 | A1 | 4/2011 | Oldknow et al. | |

OTHER PUBLICATIONS

USPTO Final Office Action mailed Jan. 18, 2012 in U.S. Appl. No. 12/760,953 (10 pages).

* cited by examiner

GOLF CLUB HEAD WITH FACE INSERT

CROSS-REFERENCE TO RELATED APPLICATION

This application is a continuation of U.S. patent application Ser. No. 13/524,743 filed Jun. 15, 2012, which is a continuation of U.S. patent application Ser. No. 12/760,953, filed Apr. 15, 2010, the contents of which are hereby incorporated by reference in their entirety.

FIELD OF THE INVENTION

The present invention relates generally to a golf club head with a face insert that is only partially connected to the body of the golf club head. More specifically, the present inventions relates to a golf club head with a face insert, wherein the face insert is only connected to the body of the golf club head at strategic engagement portions increasing the Coefficient Of Restitution (COR) of the golf club head as well as removing unnecessary weight around the perimeter of the face insert. Even more specifically, the present invention relates to a golf club head with a face insert wherein less than 100% of the external perimeter region of the face insert engages the body of the golf club head.

BACKGROUND OF THE INVENTION

In order to improve the performance of a golf club beyond the current design constraints, golf club designers are often required to think outside the box and experiment with unconventional golf club designs. One example of this type of forward thinking is the recent usage of a face insert that is made out of a different material to replace the striking plate portion of a golf club head. These face inserts can be made out of a completely different material than the remainder of the body, allowing a golf club designer to improve durability of the golf club head, increase COR of the golf club head, and generate more discretionary weight within the golf club head. More specifically, the face insert may be made out of a titanium material that is lighter and more durable, resulting in improved durability, increased COR, and better weight distribution. Durability, weight savings, and additional COR are all important performance factors of a golf club that need to be considered when designing a golf club head to properly incorporate such a face insert design.

U.S. Pat. No. 5,362,055 to Rennie ('055 patent) illustrates one of the earlier attempts to utilize a face insert manufactured independently of the body in a metal wood type golf club head. More specifically, the '055 patent discloses a metal wood that has a nonmetallic insert secured to a cavity formed in the ball face insert and reinforced by ribs on the interior of the face and the walls of a cavity formed in the club face insert. The insert is secured in the cavity by adhesion which is enhanced by channels formed in the insert cavity and hollow columns formed in the insert.

U.S. Pat. No. 3,970,236 to Rogers ('236 patent) illustrates the same concept of utilizing a face insert that is manufactured independently of the remainder of the body, but in an iron type golf club head. More specifically, the '236 patent discloses a method of manufacturing that comprises casting a head having a hosel, neck, and body dependent thereon and providing the body with an open cavity in its face that extends from at least one edge thereof across a substantial portion of the face and to a first depth therein. The plate is preferably fused to the head by an electron fusion step to produce a homogenous head having an internal cavity.

In order to further push the envelope of the design constraints of a golf club, golf club designers have improved upon the usage of a face insert by creating inserts that have a variable face thickness. Having a face insert that has variable thicknesses is advantageous and desirable because it allows strategic areas of the face to deflect as a uniform body when impacting a golf ball, yielding a more evenly distributed ballspeed across a greater region of the face insert.

U.S. Pat. No. 6,638,182 to Kosmatka ('182 patent) illustrates one of these attempts to vary the thickness of the face insert by disclosing a golf club head having a thin face insert with a smooth exterior surface and a thin layer disposed on the exterior surface. The face insert has a thickness in the range of 0.010 inch to 0.200 inch, and the thin layer has a thickness in the range of 0.003 inch to 0.050 inch. The face insert may have a uniform thickness or a variable thickness.

Despite all of the advantages of utilizing a face insert made out of a separate material independently and separately from the body of the golf club head, utilizing such a face insert comes with significant design challenges. More specifically, because the face insert of the golf club head is the part of the golf club head that is subjected to the most extreme stress, connecting a face insert to the body of the golf club head at such extreme stress areas requires a significant bond strength. U.S. Pat. No. 7,479,070 to Hirano ('070 patent) discusses and confirms the extreme amount of stress at the face insert of the golf club head by indicating that the club face of a golf club head is the point of maximum stress.

In order to address this issue of connecting a face insert to the body of the golf club head at an area that has the highest stress levels, it is not uncommon for golf club designers to utilize a strong bonding process such as perimeter welding to affix the face insert to the body of the golf club head. U.S. Pat. No. 6,669,577 to Hocknell et al. ('577 patent) discloses such an approach by initially stating the premise that high performance drivers employ relatively thin, high strength face materials that need to be attached to the body of the golf club head. The '577 patent then goes on to state that these faces are either formed into the curved face shape then are welded into a driver body component around the face perimeter or forged into a cup shape and connected to a body by either welding or adhesive bonding.

Hence, as it can be seen from above, despite all the advancement in utilization of face insert, the current art has been unable to sufficiently address this durability issue associated with the connectivity of the face insert with the body of the golf club head in a manner that does not involve excessive perimeter welding. The connection methods used by the current art involve extensive and excessive welding similar to those discussed in the '577 patent, and these methods of excessive perimeter welding generate excessive weight that may hinder the performance of the golf club head itself. Ultimately, it can be deduced that there is a need in the art for a golf club wherein the face insert is connected to the body of the golf club in an unconventional method that is less clunky and burdensome. More specifically, there is a need in the art for a golf club with a face insert wherein the face insert can be connected to the body of the golf club in a way that eliminates the unnecessary bonding weight while at the same time maintain the strength and durability to withstand the impact of a golf ball.

BRIEF SUMMARY OF THE INVENTION

One aspect of the present invention is a golf club head comprising a body with an opening that defines an internal periphery region and a face insert adapted to be connected to a forward portion of the body around the internal periphery region. The internal periphery region further comprises an engagement portion and a non-engagement portion, wherein the face insert is adapted to be connected to the body around the internal periphery region only via the engagement portion, and wherein the engagement portion encompasses less than about 100% of the internal periphery region.

In another aspect of the present invention is a golf club head comprising a body and a face insert adapted to be connected to a forward portion of the body. The face insert here further comprises an external periphery region, wherein less than 100% of the external periphery region of the face insert engages the body.

In a further aspect of the present invention is a golf club head comprising a body and a face insert adapted to be connected to a forward portion of the body. The face insert further comprises an external periphery region, wherein the external periphery region further comprises an engagement portion and a non-engagement portion. The face insert is connected to the body in a way such that only the engagement portion of the external periphery region contacts the body, and the engagement portion encompasses less than 100% of the external periphery region of the face insert. Finally, the golf club head has an engagement ratio of less than about 1. The engagement ratio is calculated by dividing a percentage of the external periphery region covered by the engagement portion by a percentage of the external periphery region covered by the non-engagement portion.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
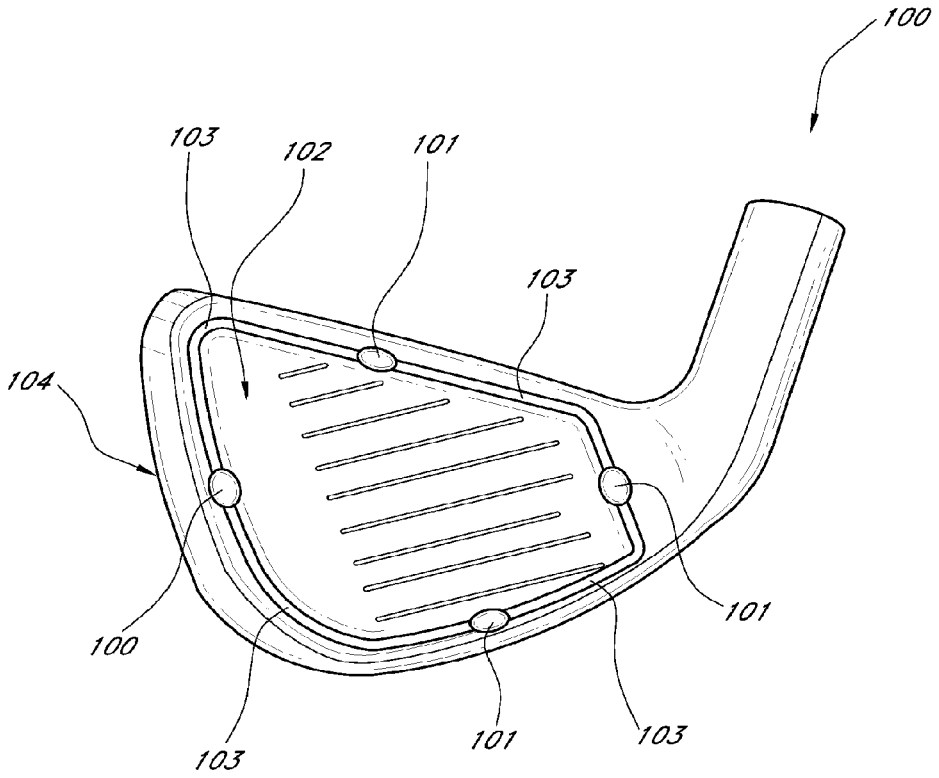
FIG. 1 shows a perspective view of a golf club head in accordance with an exemplary embodiment of the present invention.

FIG. 1 of the accompanying drawings shows a perspective view of the inventive golf club head 100 in accordance with an exemplary embodiment of the present invention. More specifically, FIG. 1 shows a golf club head 100 with a face insert 102 and a body 104; wherein the face insert is adapted to be connected to a forward portion of the body 104. One of the most important features to identify in FIG. 1 is the gap between the face insert 102 and the body 104, signifying that the face insert 102 is only partially connected to the body 104 of the golf club head 100. This partial connection between the face insert 102 and the body 104, may improve the performance of the golf club head 100 by increasing the COR while removing unnecessary weight between the face insert 102 and the body 104 of the golf club head 100 used for joining the two components together.

This partial connection discussed above may be more clearly separated into an engagement portion 101 portion and a non-engagement portion 103. The engagement portion 101 connects the face insert 102 with the body 104 while the non-engagement portion is shown here as an empty space between the face insert 102 and the body 104. The engagement portions 101 may generally be formed through a welding process that joins the two separate components in accordance with an exemplary embodiment of the present invention. Engagement portion 101, although most preferably formed by a welding process, could also be formed by a swaging process, a gluing process, a burning process, a soldering process, or even utilizing screws, all without departing from the scope and content of the present invention. The swaging process, as described in this current exemplary embodiment of the present invention may generally be accomplished using a forging process in which the dimensions of an item are altered using a die into which the item is forced.

FIG. 1 also shows the face insert 102 being only partially connected to the body 104, leaving the non-engagement portions 103 to occupy parts of the perimeter of the face insert 102 where the face insert 102 and the body 104 are not engaged with one another. The empty spaces formed by the plurality of non-engagement portions 103 may generally remain unsupported, resulting in significant weight savings around the periphery regions of the face insert 102. However, in an alternative embodiment of the present invention, the non-engagement portions 103 may not be empty gaps but could be filled with a vibration dampening material that helps dampen the vibration between the face insert 102 and the body 104 without departing from the scope and content of the present invention.

The vibration dampening material that could be used to fill in the non-engagement portion 103 gap between the face insert 102 and the body 104 may generally be a polymer type material for its vibration absorption properties; however, numerous other materials such as plastic, urethane, rubber, ceramic, or any other material capable of absorbing the vibration between the face insert 102 and the body 104 may all be used without departing from the scope and content of the present invention. In addition to providing vibration dampening, the vibration dampening material sandwiched between the face insert 102 and the body 104 may also provide structural rigidity and support to the face insert 102, helping absorb and dissipate the forces that can result when the golf club head 100 hits a golf ball.

Figure 2:
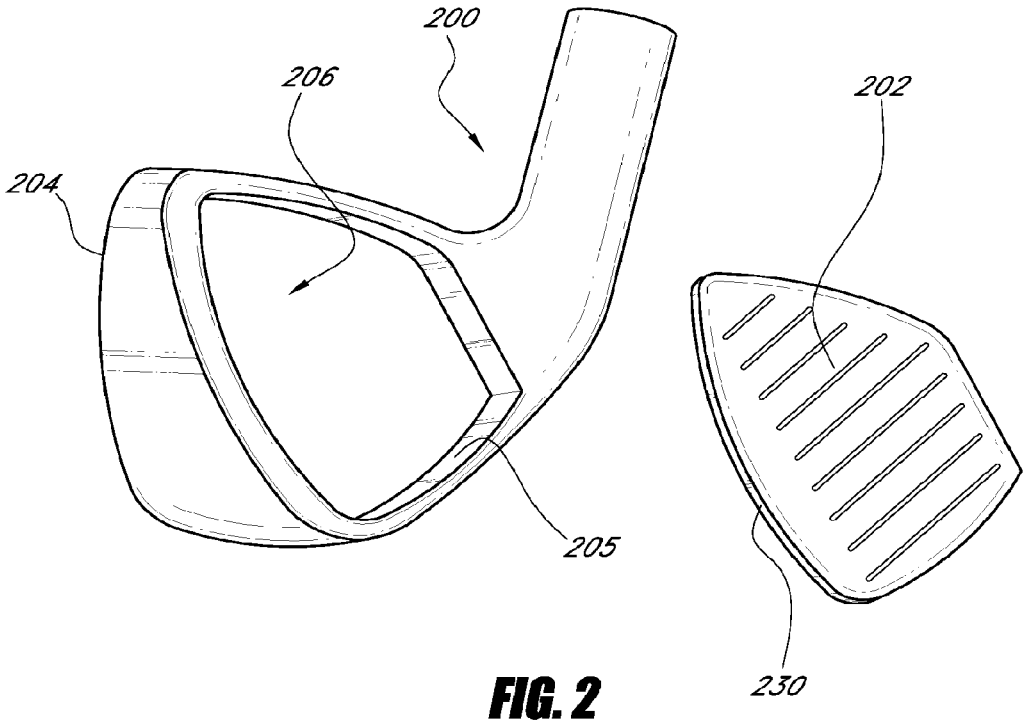
FIG. 2 shows an exploded perspective view of a golf club head in accordance with an exemplary embodiment of the present invention.

FIG. 2 of the accompanying drawings shows an exploded perspective view of a golf club head 200 in accordance with the exemplary embodiment of the present invention. The exploded view of the golf club head 200 shown in FIG. 2 allows a better visualization of how the face insert 202 interfaces with the body 204 of the golf club head 200. More specifically, the face insert 202 may generally be in the form of a plate that may be inserted into an opening 206 positioned near the forward portion of the body 204 of the golf club head 200. The exploded view of the golf club 200 shown in FIG. 2 allows the external periphery region 230 of the face insert 202 and the internal periphery region 205 of the body 204 be shown in more detail. The external periphery region 230 and the internal periphery region 205 are important to the assembly of the golf club head 200 because those regions may partially engage one another via an engagement portion 101 (shown in FIG. 1) to secure the face insert 202 to the body 204 of the golf club head 200.

It should be noted that in one exemplary embodiment, the opening 206 of the body 204 may not contain any backing or structural support for the face insert 202. This lack of a backing or structural support in the opening 206 portion of the body 204 leaves the engagement portion 101 (shown in FIG. 1) as the only support between the face insert 202 and the body 204, eliminating unnecessary weight around the perimeter of the face insert 204 traditionally reserved for bonding the external periphery region 205 and the internal periphery region 230. Decreasing unnecessary weight within the golf club head 200 may generally be advantageous to the performance of a golf club because the weight savings could be used to improve the Center of Gravity (CG) and Moment of Inertia (MOI) properties of the golf club head 200 by shifting the discretionary weight towards a more strategically beneficial position.

Figure 3:
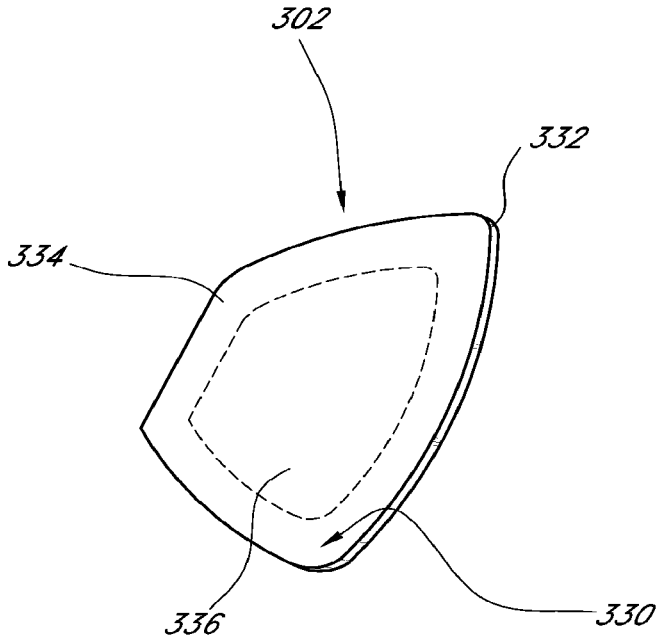
FIG. 3 shows a perspective view of the back of a face insert of a golf club head in accordance with an exemplary embodiment of the present invention.

FIG. 3 of the accompanying drawings shows the perspective view of the back side of the face insert 302 and more clearly depicts the boundaries of the external periphery region 330 on the face insert 302. External periphery region 330, as shown in the current exemplary embodiment is the region that interfaces with the body 204 (shown in FIG. 2), and may include several different surfaces in addition to what is visibly apparent in FIG. 2. More specifically, external periphery region 330 may include the outer region 334 of the back surface of the face insert as well as the side surface 332 of the face insert 302 as shown in FIG. 3. The external periphery region 330 of the face insert 302 may generally exclude the central region 336 of the back of the face insert 302 due to the fact that the central portion of the body 204 (shown in FIG. 2) may have a hollow opening 206 (shown in FIG. 2) prohibiting it from engaging the face insert 302.

Figure 4:
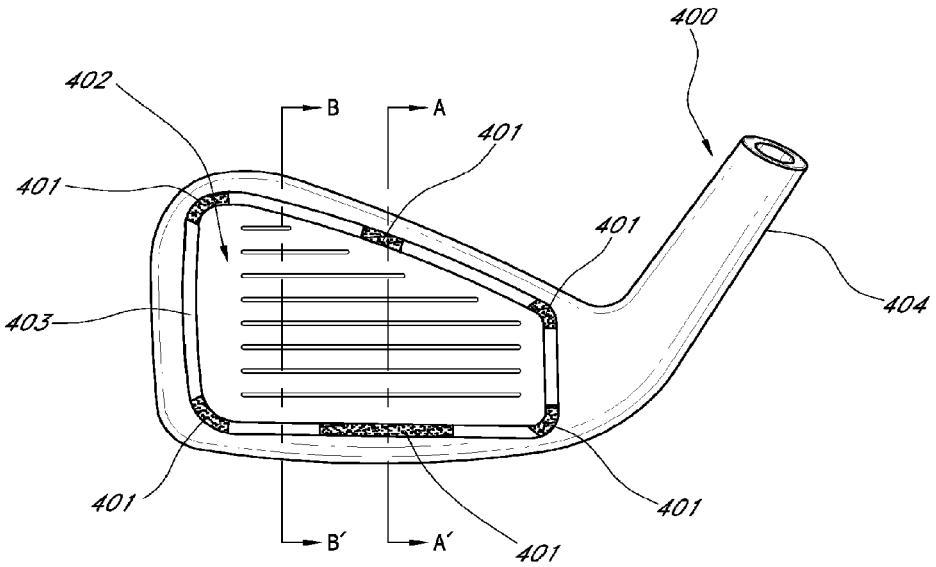
FIG. 4 shows a frontal view of a golf club head in accordance with an alternative embodiment of the present invention.

FIG. 4 of the accompanying drawings shows a frontal view of a golf club head 400 in accordance with an alternative embodiment of the present invention. The frontal view of the golf club head 400 shown in this alternative embodiment allows cross-sectional lines A-A' and B-B' to be shown more clearly. More specifically, cross-sectional lines A-A' run vertically across the center of the golf club head 400 showing how the engagement portion 401 connects the face insert 402 to the body 404. Cross-sectional lines B-B' run vertically across the golf club head 400 at a location that is offset from the center of the golf club head 400, showing how non-engagement portion 403 separates the face insert 402 and the body 404. In addition to providing the cross-sectional lines A-A' and B-B', FIG. 4 also shows the golf club head with six distinct engagement portions 401 separated by various non-engagement portions 403. By examining the number of engagement portions 101 in FIG. 1 in combination with the number of engagement portions 401 in FIG. 4, it can be concluded that the current invention is not limited by the exact number of engagement portions 404, but can have any number of engagement portions 404 around the perimeter of the face insert 402 all without departing from the scope and content of the present invention; as long as there exists one non-engagement portion 403 leaving less than 100% of the perimeter of the face insert 402 touching the body 404.

The frontal view of golf club head 400 shown in FIG. 4 also shows how the various engagement portions 401 may have different widths for the purpose of varying the structural support at different locations along the perimeter of the face plate 402 depending on the amount of impact stresses. Here in FIG. 4, we can see the engagement portion 401 near the sole of the golf club head 400 may be significantly wider than the engagement portion 401 near the top of the golf club head 400 to create a stronger bond near the bottom of the face insert 402, a location where most golfers strike the golf ball. However, the various engagement portions 401 may all have different widths at different locations depending on the structural support needs of the golf club head 400 all without departing from the scope and content of the present invention.

Figure 5:
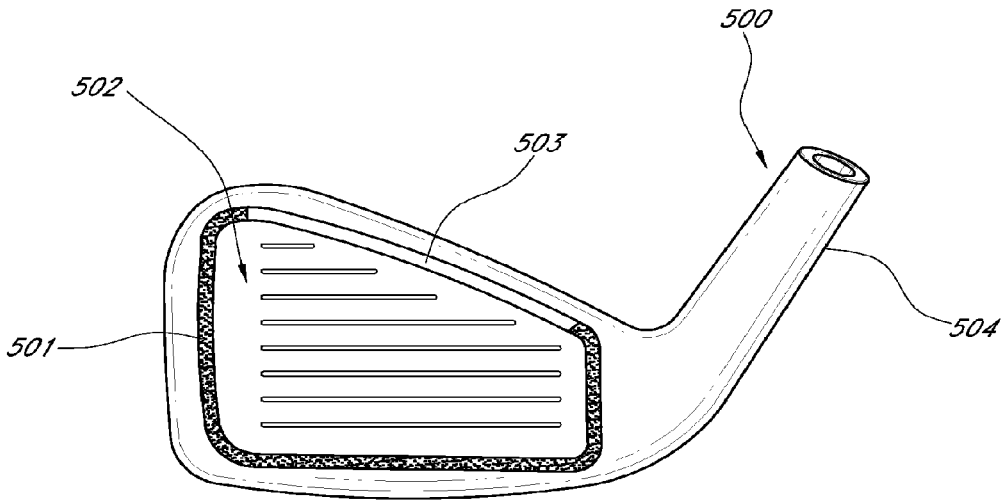
FIG. 5 shows a frontal view of a golf club head in accordance with an alternative embodiment of the present invention.

FIG. 5 of the accompanying drawings shows a frontal view of a golf club head 500 and illustrates a further alternative embodiment of the present invention wherein engagement portions 501 may encompass a significant portion of the perimeter of the face insert 502 without departing from the scope and content of the present invention. More specifically, engagement portion 501 shown in FIG. 5 may completely cover the toe portion, the heel portion, and the sole portion of the perimeter of the face insert 502 while keeping the top portion relatively unattached, yielding a non-engagement portion 503 near the top perimeter region of the face insert. Having this arrangement may be beneficial to the performance and durability of the golf club head 500, as a significant portion of the face insert 502 is rigidly supported to the body 504 of the golf club head 100. However, the specific size and length of the engagement portion 501 shown in FIG. 5 should not be limited to the configuration shown in FIG. 5; various other numbers, length, and proportions of engagement portion 501 relative to non-engagement portion 503 may be used to achieve the same purpose all without departing from the scope and content of the present invention so long as the face insert 502 is only partially connected to the body 504 of the golf club head 500.

In one preferred embodiment, the engagement portion 501 may encompass less than about 100% of the external periphery region of the face insert 502. In a more preferred embodiment of the present invention, the engagement portion 501 may encompass less than about 75% of the external periphery region of the face insert 502. In an even more preferred embodiment of the present invention, the engagement portion 501 may encompass less than about 50% of the external periphery region of the face insert 502. Finally, in a most preferred embodiment of the present invention, the engagement portion 501 may encompass less than about 25% of the external periphery region of the face insert 502.

Because the relationship between the engagement portion 501 and the non-engagement portion 503 helps determine the performance gains of a golf club head 500, it is important to define that relationship in a quantifiable manner. Equation (1) below shows the relationship between the engagement portion 501 and the non-engagement portion 503 in a quantifiable manner creating an engagement ratio.

$$\text{Engagement Ratio} = \frac{\%\text{ of perimeter covered by Engagement Portion}}{\%\text{ of perimeter covered by Non-Engagement Portion}} \quad \text{(Eq. 1)}$$

In one exemplary embodiment of the present invention the % of the perimeter covered by the engagement portion 501 may be about 90 percent and the % of the perimeter covered by the non-engagement portion 503 may be about 10 percent, yielding an engagement ratio of less than about 9. In a more preferable embodiment of the present invention, the % of the perimeter covered by the engagement portion 501 may be about 75 percent and the % of the perimeter covered by the non-engagement portion 503 may be about 25 percent yielding an engagement ratio of less than about 3. In an even more preferable embodiment of the present invention, the % of the perimeter covered by the engagement portion 501 may be about 50 percent and the % of the perimeter covered by the non-engagement portion 503 may be about 50 percent, yielding an engagement ratio of less than about 1. Finally, in a most preferred embodiment of the present invention, the % of the perimeter covered by the engagement portion 501 may be about 25 percent and the % of the perimeter covered by the non-engagement portion 503 may be about 75 percent, yielding an engagement ratio of less than about 0.33.

Figure 6:
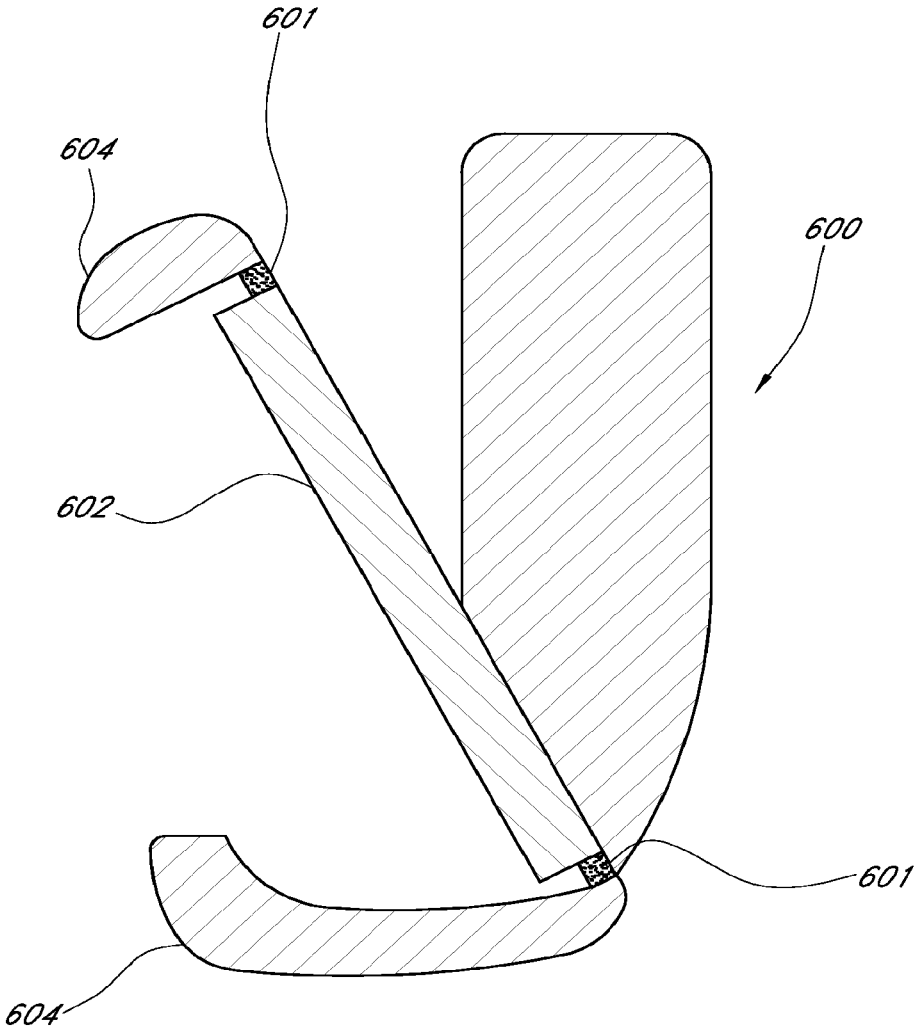
FIG. 6 shows a cross-sectional view of an alternative embodiment of the present invention taken along cross-sectional line A-A' shown in FIG. 4.

FIG. 6 of the accompanying drawings shows a cross-sectional view of a golf club head 600 taken along cross-sectional line A-A' in FIG. 4. In the cross-sectional view shown in FIG. 6, it can be seen that the engagement portion 601 joins the face insert 602 to the body 604 of the golf club head 600. The engagement portion 601, as shown in this current exemplary embodiment, may generally be weld spots near the frontal surface of the face insert 602. In addition to providing structural support, having the weld spots near the frontal surface of the face insert 602 may be desirable, as excessive weld can be easily removed from the frontal surface of the face insert 602. Although the preferred bonding method shown in FIG. 6 utilizes a welding process, numerous other processes already discussed above may be used to connect the face insert 602 to the body 604 at the engagement portion 601 all without departing from the scope and content of the present invention.

Figure 7:
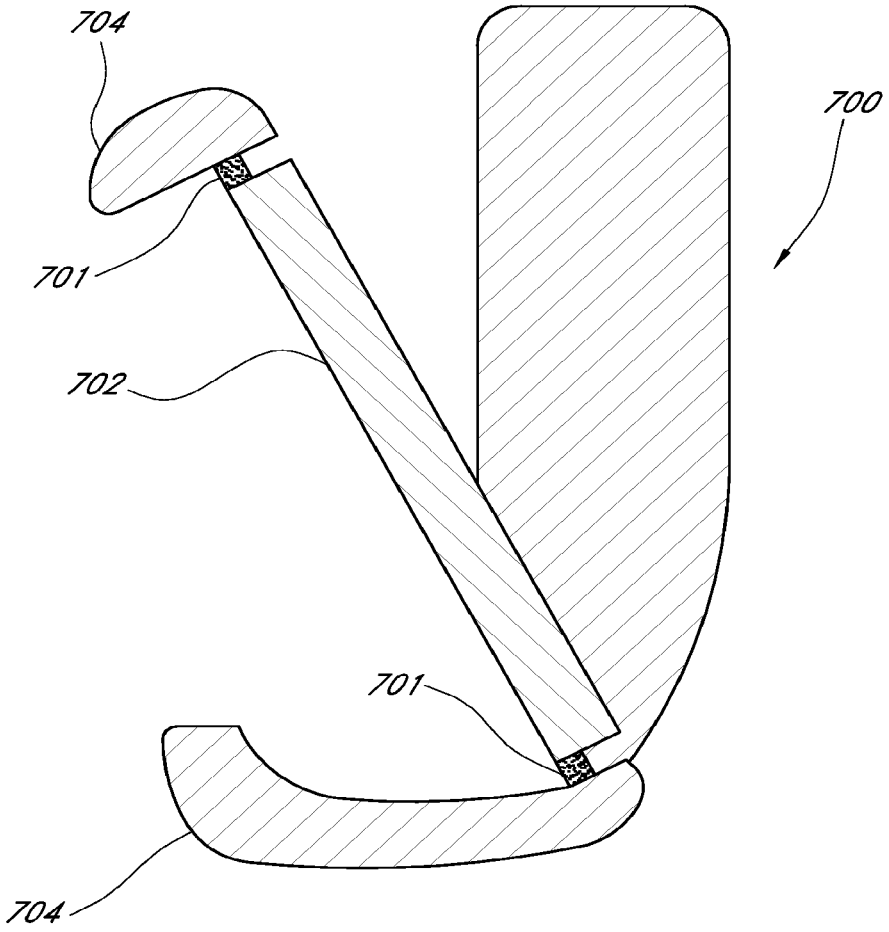
FIG. 7 shows a cross-sectional view of an alternative embodiment of the present invention taken along cross-sectional line A-A' shown in FIG. 4.

FIG. 7 of the accompanying drawings shows a cross-sectional view of a golf club head 700 in accordance with an alternative embodiment of the present invention taken along cross-sectional line A-A' in FIG. 4. More specifically, FIG. 7 shows an alternate location at the rear surface of the face insert 702 for the engagement portion 701 to connect the face insert 702 and the body 704. Having the engagement portion 701 connecting the face insert 702 to the body 704 towards the rear surface of the face insert 702, although less accessible for post machining operations, has the advantage in that the engagement portion 702 may be hidden from view. Having the engagement portion 702 hidden from view may be a preferred design alternative, as it could significantly save or completely eliminate the amount of post manufacturing processing and machining.

Figure 7A:
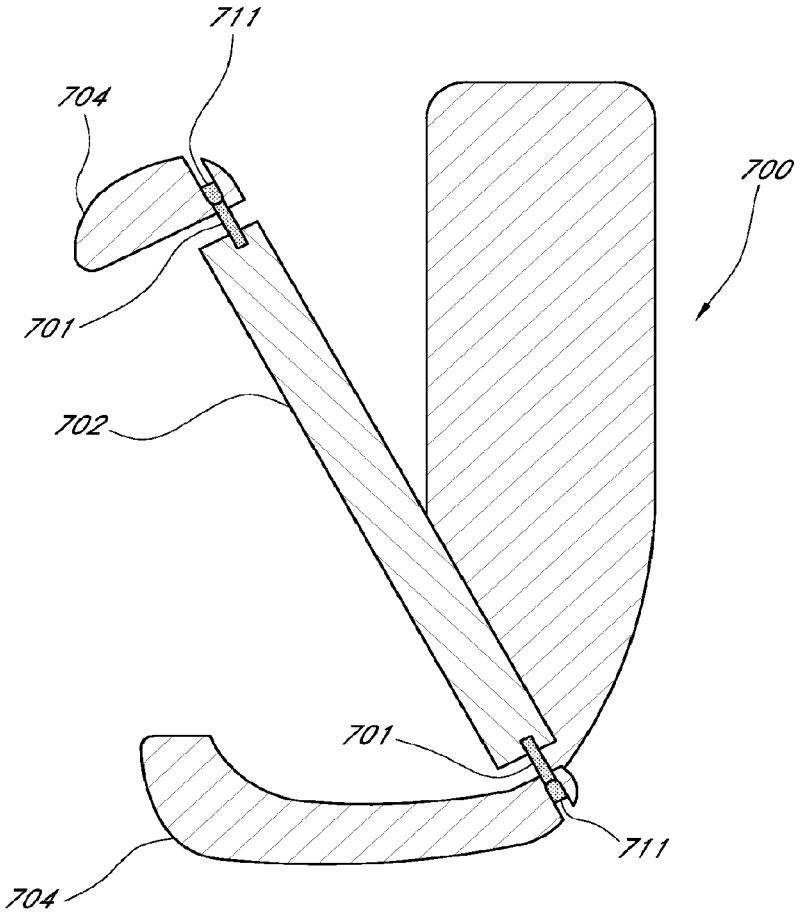
FIG. 7A shows a cross-sectional view of an alternative embodiment of the present invention taken along cross sectional line A-A' shown in FIG. 4.

FIG. 7A of the accompanying drawings shows a cross-sectional view of a golf club head 700 in accordance with a further alternative embodiment of the present invention taken along cross-sectional line A-A' in FIG. 4. More specifically, FIG. 7A shows an alternative attachment mechanism to secure the face insert 702 to the body 704 of the golf club head 700 utilizing a plurality of screws 711 for the engagement portion 701. Utilizing a plurality of screws 711 for the engagement portion 701 may be preferred in certain situations wherein the face insert 702 can be easily changed out from its location within the body 704 of the golf club head 700. It should be noted that although FIG. 7A only shows the usage of the plurality of screws 711 at one particular location, the actual location of the plurality of screws 711 that may be used to connect the face insert 702 with the body 704 is not limited to the locations depicted in FIG. 7A. In fact, a plurality of screws 711 may be used to connect the face plate 702 to the body 704 at any engagement portion 701 described in the current specifications all without departing from the scope and content of the present invention.

Figure 8:
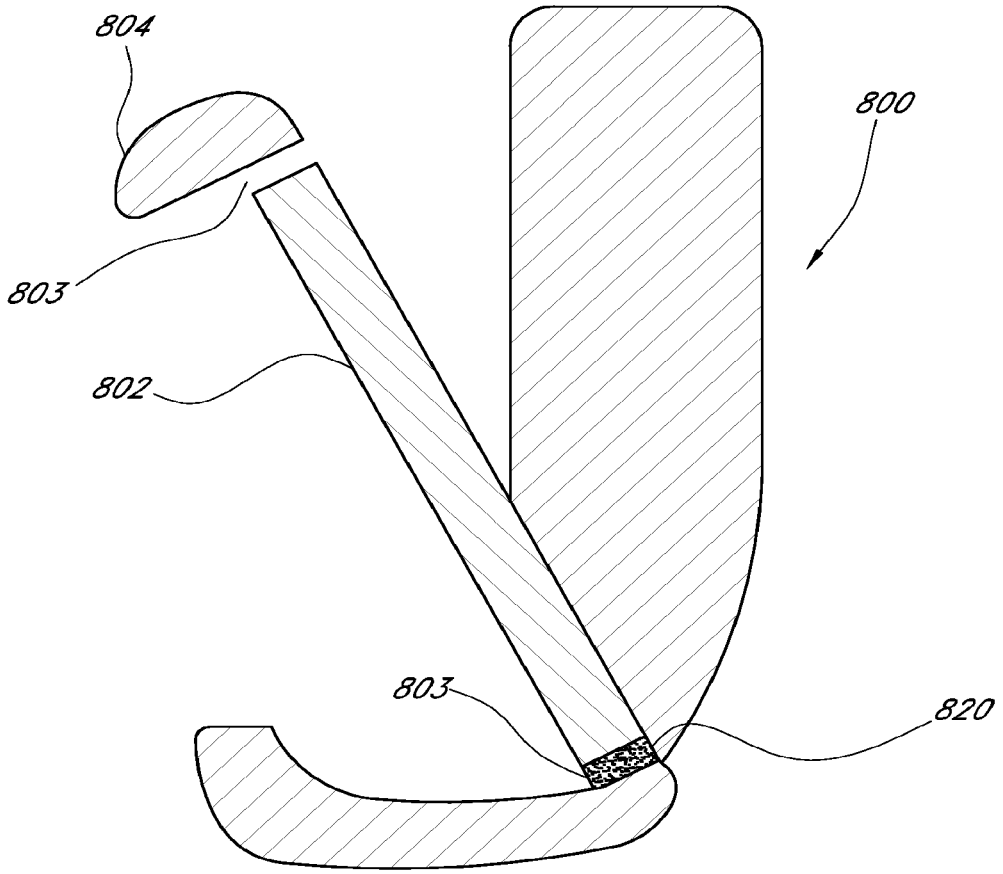
FIG. 8 shows a cross-sectional view of an alternative embodiment of the present invention taken along cross-sectional line B-B' shown in FIG. 4.

FIG. 8 of the accompanying drawings shows a cross-sectional view of a golf club head 800 taken along cross-sectional line B-B' in FIG. 4. This cross-sectional view of the golf club head 800 allows the non-engagement portion 803 to be shown in a more clearly defined manner, further accentuating the fact that the face insert 802 is not connected to the body 804 of the golf club head 800 at the non-engagement portion 803. Although the ability to fill the non-engagement portion 803 has already been discussed above, it is worth mentioning again here that the non-engagement portion 803 could very often be filled with a vibration dampening material 820 that helps absorb and dissipate some of the impact forces. Here, in this exemplary embodiment of the present invention shown in FIG. 8, the vibration dampening material 820 is only used to fill the non-engagement portion 803 near the sole portion of the perimeter of the face insert 802. In certain situations, it may be desirable to have the vibration dampening material 820 only fill in the bottom sole portion of the non-engagement portion 803 to further eliminate unnecessary weight; especially in shorter irons wherein the impact forces are not as high. However, it should be noted that the vibration dampening material 820 could be focused at other portions of the perimeter of the face insert 802, or even completely fill the non-engagement portion 803 without departing from the scope and content of the present invention.

Figure 9:
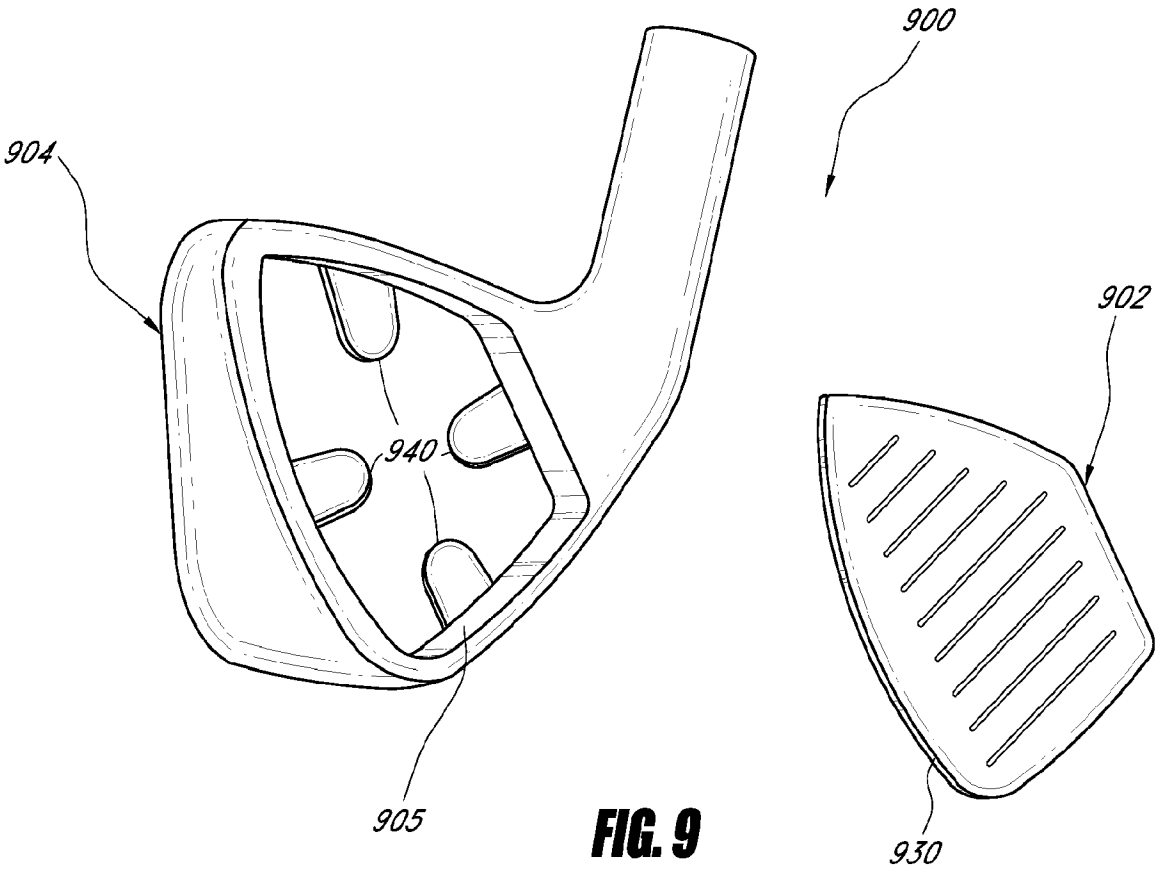
FIG. 9 shows an exploded perspective view of a golf club head in accordance with an alternative embodiment of the present invention.

FIG. 9 of the accompanying drawings shows a further alternative embodiment of the present invention wherein the body may contain a plurality of backing tabs 940 to further provide structural rigidity for the face insert 902 once it has been assembled into the body 904. More specifically, as it can be seen from FIG. 9, the plurality of backing tabs 940 may engage the external periphery region 930 at the back surface of the face insert 902 to provide additional structural support for the face insert 902. However, in order to examine more closely the relationship between the face insert 902 and plurality of backing tabs 904, one has to turn to a cross-sectional view of the golf club head 900 shown in FIGS. 10-11 below.

Figure 10:
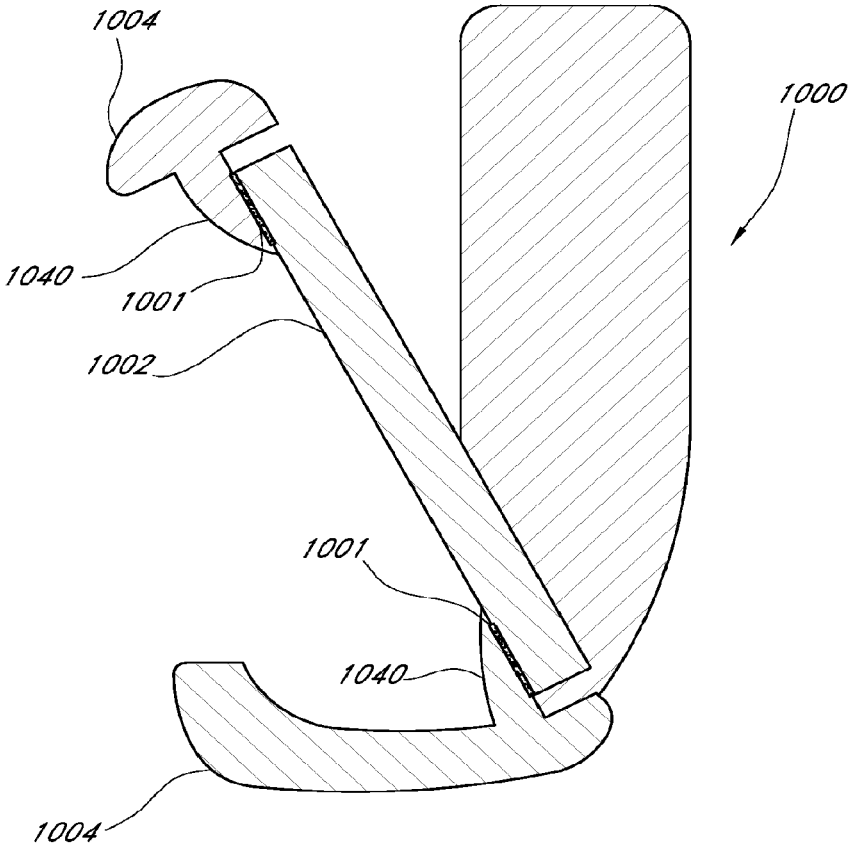
FIG. 10 shows a cross-sectional view of an alternative embodiment of the present invention taken along cross-sectional line A-A' shown in FIG. 4.

FIG. 10 shows a cross-sectional view of a golf club head 1000 in accordance with the alternative embodiment of the present invention shown in FIG. 9. More specifically, the cross-sectional view of the golf club head 1000 shown in FIG. 10 is taken across the same cross-sectional line A-A' shown in FIG. 4, illustrating the engagement portion 1001 between the face insert 1002 and the body 1004. It should be noted that the engagement portion 1001 shown in FIG. 10 may generally be at the rear surface of the face insert 1002 engaging the plurality of backing tabs 1040 instead of around the side surfaces of the face insert 1002. Engagement portion 1001, similar to the discussion above, may most preferably be formed by a welding process; however numerous other methodologies such as swaging, gluing, burning, soldering, or even utilization of screws may all be used without departing form the scope and content of the present invention.

Figure 11:
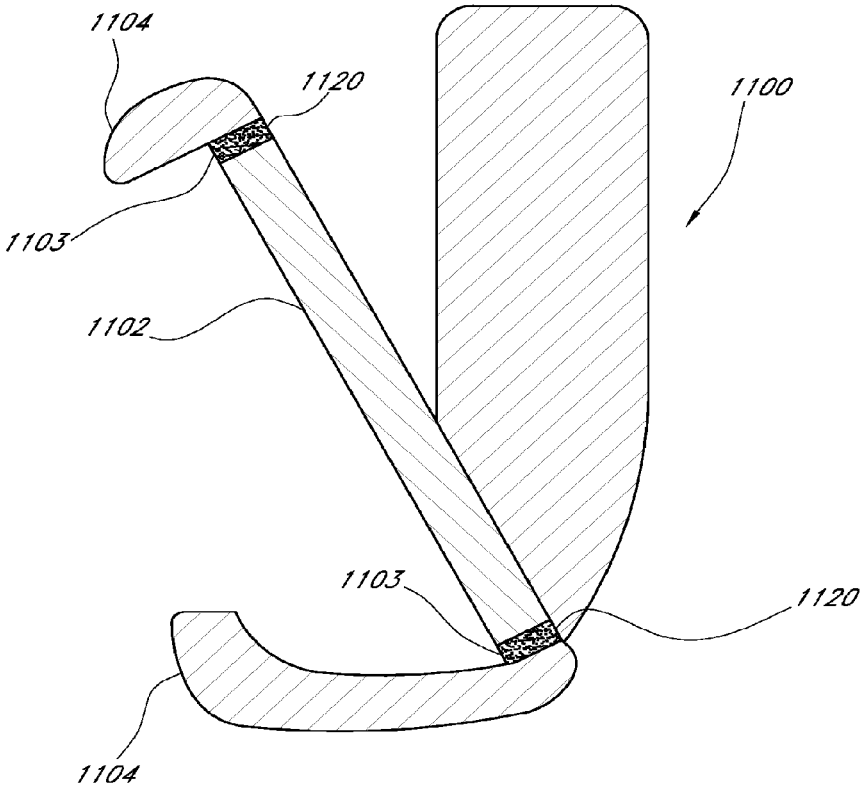
FIG. 11 shows a cross-sectional view of an alternative embodiment of the present invention taken along cross-sectional line B-B' shown in FIG. 4.

FIG. 11 of the accompanying drawings shows a cross-sectional view of a golf club head 1100 in accordance with the alternative embodiment of the present invention shown in FIG. 9. More specifically, the cross-sectional view of the golf club head 1100 shown in FIG. 11 is taken across the same cross-sectional line B-B' shown in FIG. 4, illustrating the non-engagement portion 1103 between the face insert 1102 and the body 1104. In this alternative embodiment of the present invention a vibration dampening material 1120 may completely fill up the entire non-engagement portion 1103 of the perimeter of the face insert 1102, maximizing the vibration dampening capability of the non-engagement portion 1103. However, similar to the embodiments discussed above, the vibration dampening material 1120 need not completely fill the non-engagement portion 1103 and could partially fill the non-engagement portion 1103 at strategic locations without departing from the scope and content of the present invention.

Figure 12A:
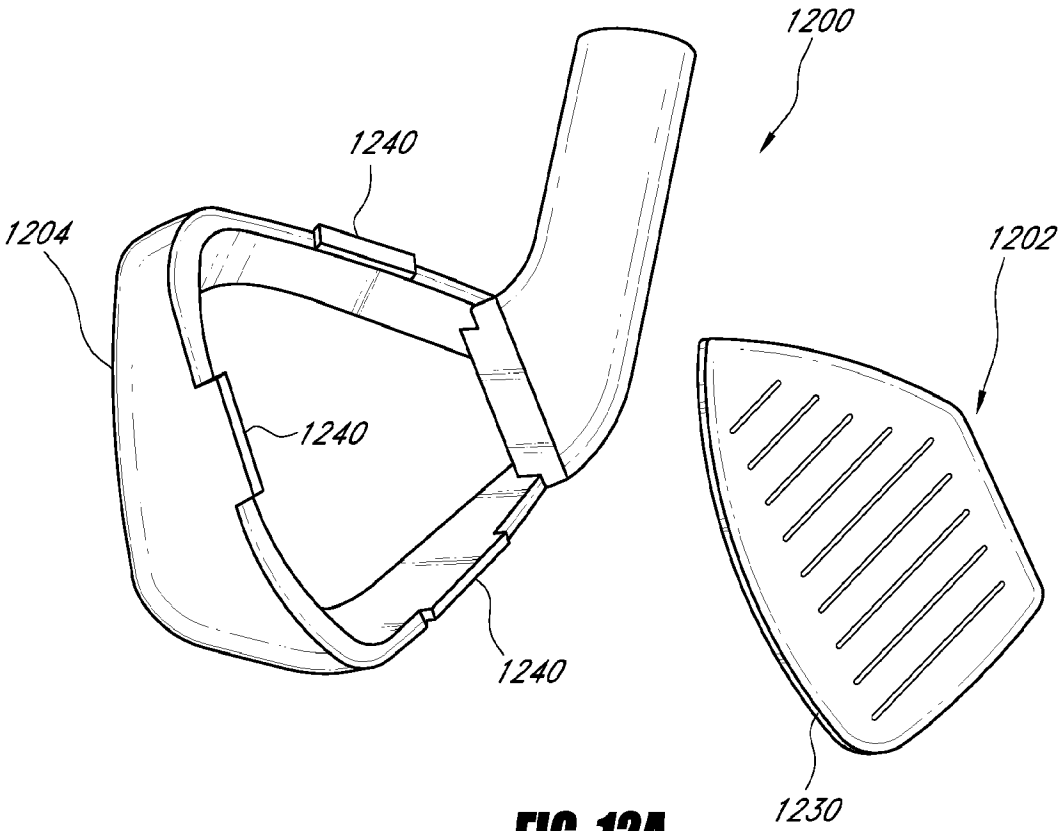
FIG. 12A shows an exploded perspective view of a golf club head in accordance with an alternative embodiment of the present invention.
Figure 12B:
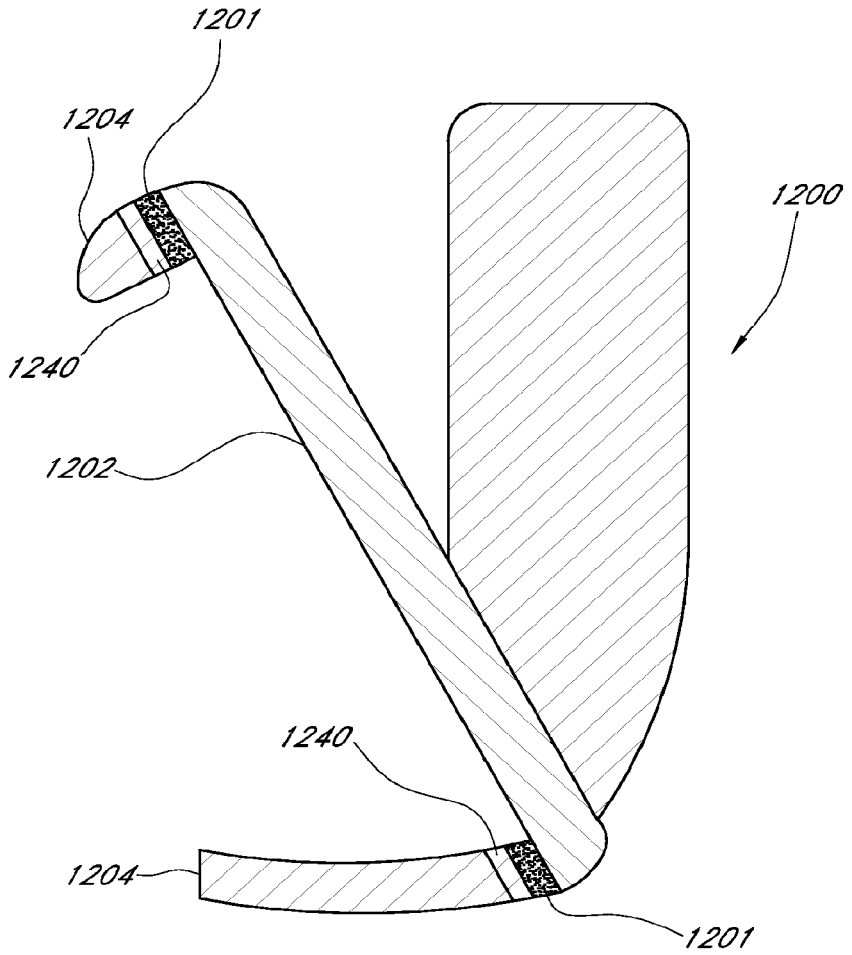
FIG. 12B shows a cross-sectional view of an alternative embodiment of the present invention taken along cross-sectional line A-A' shown in FIG. 4.
Figure 12C:
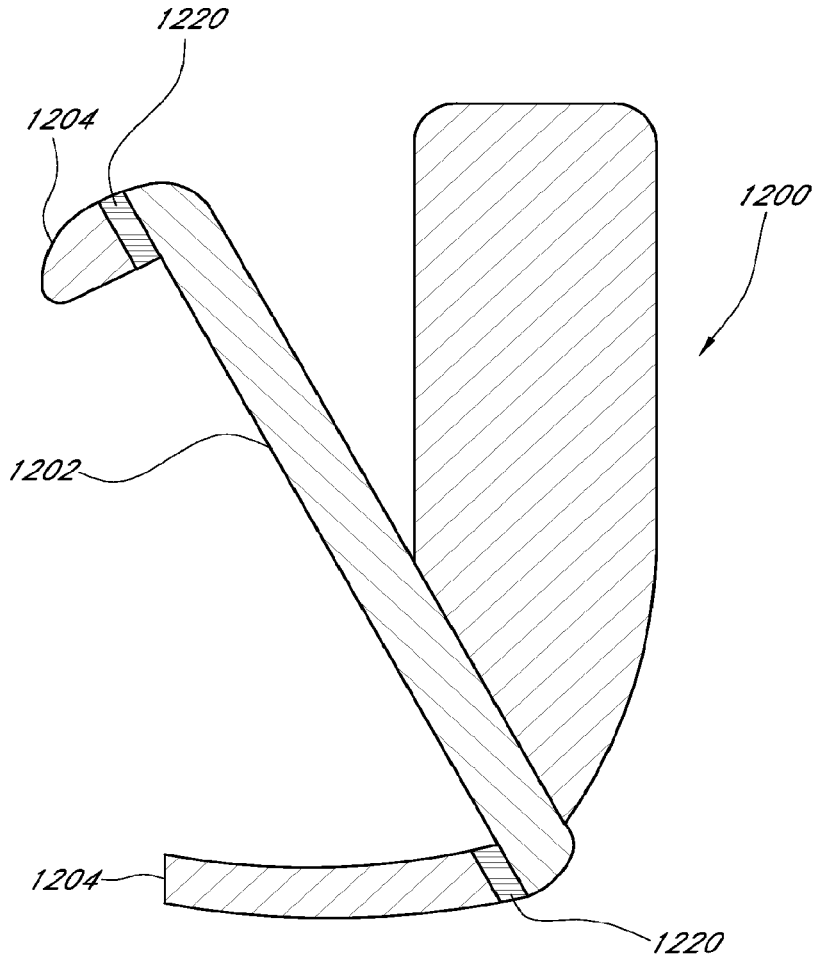
FIG. 12C shows a cross-sectional view of an alternative embodiment of the present invention taken along cross-sectional line B-B' shown in FIG. 4.

FIGS. 12A, 12B, and 12C of the accompanying drawings shows a further alternative embodiment of the present invention wherein the plurality of backing tabs 1240 protrude out from the body 1204, creating an engagement portion 1201 that connects the face insert 1202 to the body 1204. This alternative embodiment may be preferred in situations where it is desirable to maintain a face insert 1202 shape that is relatively flat while providing an alternative way to connect the face insert 1202 to the body 1204. It should be noted that although the current exemplary embodiment shows only three backing tabs 1240 to help distribute the impact forces of the face insert 1202, any various number of backing tabs 1240 may be used around the perimeter of the body 1204 to provide support for the face insert 1202 without departing from the scope and content of the present invention.

Figure 13A:
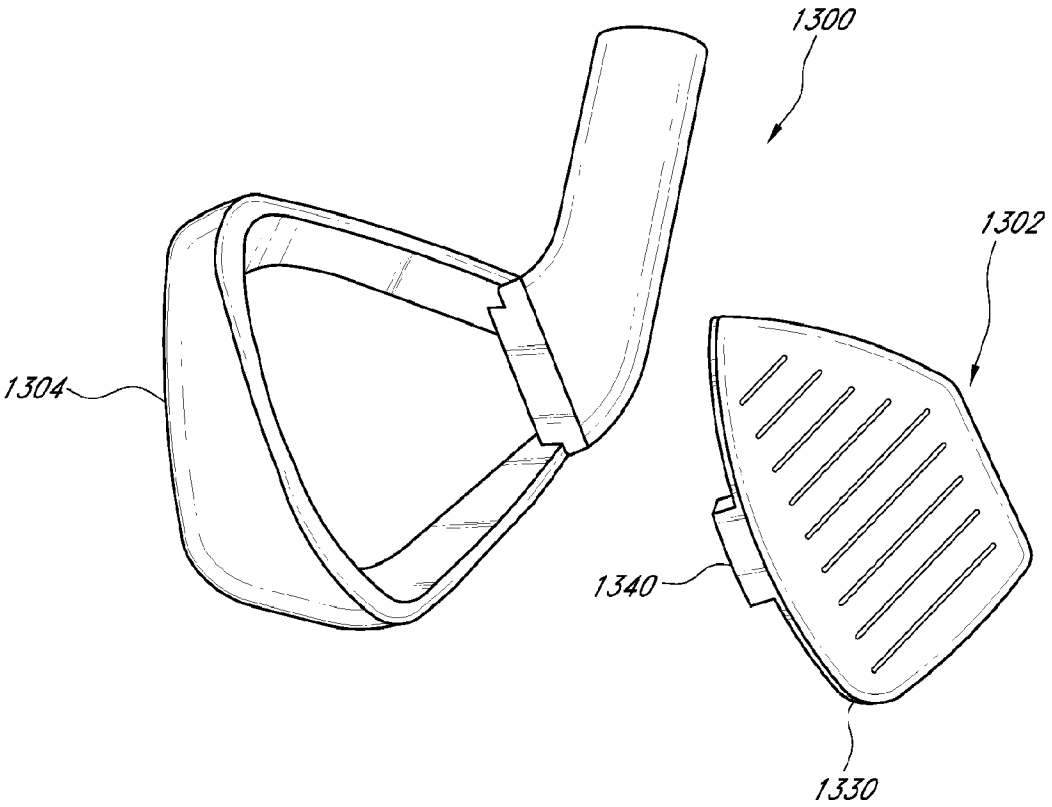
FIG. 13A shows an exploded perspective view of a golf club head in accordance with an alternative embodiment of the present invention.
Figure 13B:
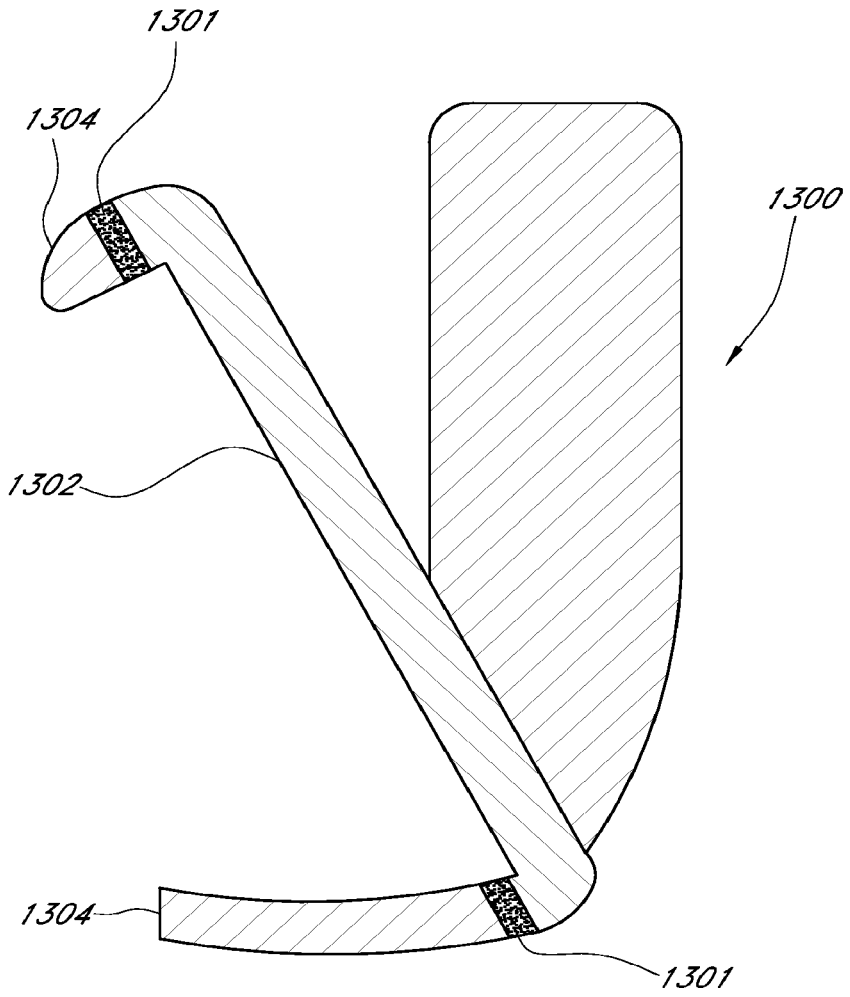
FIG. 13B shows a cross-sectional view of an alternative embodiment of the present invention taken along cross-sectional line A-A' shown in FIG. 4.
Figure 13C:
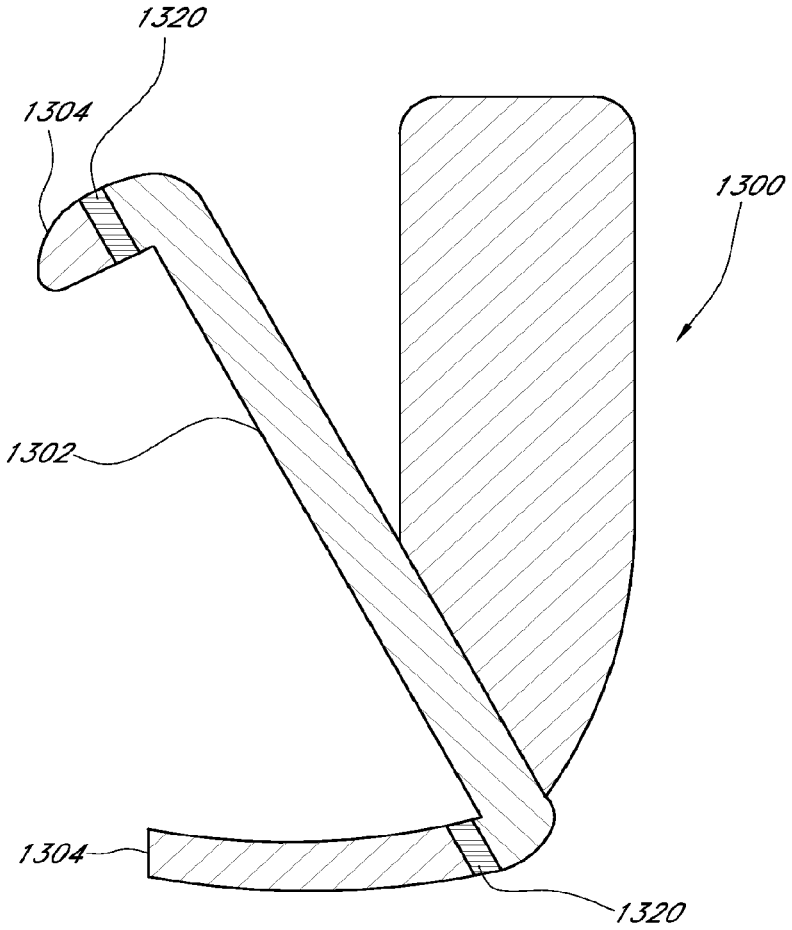
FIG. 13C shows a cross-sectional view of an alternative embodiment of the present invention taken along cross-sectional line B-B' shown in FIG. 4.

FIGS. 13A, 13B, and 13C of the accompanying drawings shows a further alternative embodiment of the present invention wherein the plurality of backing tabs 1340 protrude out from the rear surface of the external engagement portion 1330 of the face insert 1302, creating an engagement portion 1301 that connects the face insert 1302 to the body 1304. This alternative embodiment may be preferred in situations wherein an alternative manufacturing technique mandates a flatter frontal surface for the body 1304. Similar to above, the plurality of backing tabs 1340 is not limited to what can be shown in FIGS. 13A, 13B, and 13C, but could be any number of backing tabs 1340 so long as it leaves sufficient room for the non-engagement portion all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the following portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron-type golf club head comprising:

a body with an opening defining an internal periphery region and a face insert adapted to be connected to a forward portion of the body around the internal periphery region, wherein the internal periphery region further comprises:

an engagement portion; and a non-engagement portion, wherein the face insert is welded to the body at the internal periphery region only via the engagement portion and spaced away from the body everywhere at the non-engagement portion to define an opening through the club head from an area out in front of the club head to a space out behind the club head and further wherein the engagement portion encompasses less than about 100% of the internal periphery region.

2. The golf club head of claim 1, wherein the engagement portion encompasses less than about 75% of the internal periphery region.

3. The golf club head of claim 1, wherein the golf club head has an engagement ratio of less than about 1; wherein the engagement ratio is calculated by dividing a percentage of the internal periphery region covered by the engagement portion by a percentage of the internal periphery region covered by the non-engagement portion.

4. An iron-type golf club head comprising:

a body; and a face insert comprising an external periphery region, wherein the external periphery region further comprises:

an engagement portion comprising less than 100% of the external periphery region; and a non-engagement portion, wherein the face is welded to the body via only the engagement portion, and the non-engagement portion is everywhere separated from the body by an empty gap.

5. An iron-type golf club head comprising:

a body; and a face insert adapted to be connected to a forward portion of the body, the face insert comprising an external periphery region, the external periphery region comprising:

an engagement portion; and a non-engagement portion, wherein only the engagement portion of the external periphery region engages the body, the face insert is welded to the body at the engagement portion, and wherein the engagement portion encompasses less than 50% of the external periphery region of the face insert, the golf club head further comprising a separation between the face insert and the body throughout an entirety of the non-engagement portion.

6. The golf club head of claim 5, wherein the separation between the face insert and the body defines an opening through the club head from an area out in front of the club head to a space out behind the club head.

7. The golf club head of claim 5, wherein the engagement portion encompasses less than 25% of the external periphery region of the face insert.

8. An iron-type golf club head comprising:

a body with a heel, a sole, a toe, a top, and a hosel extending from the heel;

a face insert connected to, and surrounded in all directions by, the body; and a gap between the face insert and the body wherein the gap defines an empty space through the club head from an area out in front of the club head to a space out behind the club head separating the face insert from the body along at least 25% of a perimeter of the face insert.

9. The club head of claim 8, wherein the face insert is welded to the body.

10. The club head of claim 8, wherein the face insert is connected to the body via a plurality of engagement portions disposed along a perimeter of the face insert.

11. The club head of claim 10, wherein a first one of the plurality of the engagement portions is near the sole is wider than a second one of the plurality of the engagement portions near the top.

12. The club head of claim 8, wherein the face insert is connected to the body via an engagement portion that completely covers a toe portion, a heel portion, and a sole portion of a perimeter of the face insert.

* * * * *